US010092160B2

(12) United States Patent
Ju et al.

(10) Patent No.: US 10,092,160 B2
(45) Date of Patent: Oct. 9, 2018

(54) DISHWASHER

(71) Applicant: LG Electronics Inc., Seoul (KR)

(72) Inventors: Byeonghyeon Ju, Seoul (KR); Younghwan Park, Seoul (KR); Minkyung Jung, Seoul (KR)

(73) Assignee: LG Electronics Inc., Seoul (KR)

( * ) Notice: Subject to any disclaimer, the term of this patent is extended or adjusted under 35 U.S.C. 154(b) by 1132 days.

(21) Appl. No.: 13/853,177

(22) Filed: Mar. 29, 2013

(65) Prior Publication Data

US 2013/0255733 A1 Oct. 3, 2013

(30) Foreign Application Priority Data

Mar. 30, 2012 (KR) ..... 10-2012-0033157

(51) Int. Cl.
*A47L 15/23* (2006.01)

(52) U.S. Cl.
CPC ..... *A47L 15/23* (2013.01)

(58) Field of Classification Search
CPC ..... A47L 15/23; A47L 15/4282; A47L 15/20; A47L 15/22; A47L 2401/24; A47L 2501/20
See application file for complete search history.

(56) References Cited

U.S. PATENT DOCUMENTS 1,408,077 A * 2/1922 Clinton ..... A47L 15/20 134/179
3,160,164 A 12/1964 Constance
3,261,554 A * 7/1966 Perl ..... A47L 15/23 134/178
3,596,834 A * 8/1971 Cushing ..... A47L 15/23 239/227
3,645,791 A * 2/1972 Sadwith ..... A47L 15/30 134/144
3,841,342 A * 10/1974 Cushing ..... A47L 15/23 134/144
5,241,975 A * 9/1993 Yanagihara ..... A47L 15/18 134/56 D (Continued)

FOREIGN PATENT DOCUMENTS

CN 1190571 A 8/1998
CN 101049224 A 10/2007

(Continued)

OTHER PUBLICATIONS

Chinese Office Action dated Aug. 11, 2015 for Chinese Appln. No. 201310106593.5, with English Translation, 20 pages.

(Continued)

*Primary Examiner* — Marc Lorenzi
(74) *Attorney, Agent, or Firm* — Fish & Richardson P.C.

(57) ABSTRACT

A dishwasher including a cabinet which forms an exterior appearance thereof, the cabinet having a door on one side thereof, which can be opened and closed, a tub provided in the cabinet to form a cleaning object housing space, a rack provided to the tub for securing cleaning objects thereto, a spray module rotatably provided for spraying cleaning water toward the cleaning objects, and a supply flow passage for supplying the cleaning water to the spray module, thereby permitting to provide a housing space larger than an existing dishwasher, and a spray module which can wash cleaning objects with an excellent effect.

4 Claims, 9 Drawing Sheets

(56) References Cited

U.S. PATENT DOCUMENTS

| | | | | | |
|---|---|---|---|---|---|
| 5,944,037 | A | * | 8/1999 | Sinyong | A47L 15/23 134/176 |
| 2007/0235063 | A1 | | 10/2007 | Lee | |
| 2009/0101185 | A1 | | 4/2009 | Pardini | |
| 2011/0139181 | A1 | | 6/2011 | Lee | |

FOREIGN PATENT DOCUMENTS

| | | | | | |
|---|---|---|---|---|---|
| CN | 101627893 | A | | 1/2010 | |
| CN | 101947091 | A | | 1/2011 | |
| DE | 1265366 | B | | 4/1968 | |
| DE | 102005026558 | B3 | | 11/2006 | |
| EP | 1 842 476 | A2 | | 10/2007 | |
| EP | 2 052 663 | A2 | | 4/2009 | |
| EP | 2 272 415 | A2 | | 1/2011 | |
| EP | 2 572 623 | A1 | | 3/2013 | |
| GB | 993692 | | | 6/1965 | |
| GB | 1354514 | A | * | 6/1974 | A47L 15/4289 |
| GB | 2 017 486 | A | | 10/1979 | |
| GB | 2313299 | A | * | 11/1997 | A47L 15/4282 |
| JP | 9010159 | A | | 1/1997 | |
| KR | 2005106803 | A | | 11/2005 | |
| TW | 201200087 | A | | 1/2012 | |
| WO | WO 2011/132356 | A1 | | 10/2011 | |
| WO | WO 2011/144540 | A2 | | 11/2011 | |

OTHER PUBLICATIONS

German Office Action dated Dec. 19, 2013 for Application No. 10 2013 205 620.6, with English Translation, 8 pages.

Search Report issued in French Application No. 1352643 dated Jan. 13, 2016, 11 pages (with English translation).

Chinese Office Action dated Jan. 29, 2015 for Chinese Application No. 201310106593.5, with English Translation, 15 Pages.

UK Office Action dated Jul. 22, 2013 for Application No. 1305515.7, in English, 6 pages.

* cited by examiner

DISHWASHER

CROSS REFERENCE TO RELATED APPLICATIONS

This application claims the benefit of the Korean Patent Application No. 10-2012-0033157, filed on Mar. 30, 2012, which is hereby incorporated by reference as if fully set forth herein.

BACKGROUND OF THE DISCLOSURE

Field of the Disclosure

The following disclosure is related to dishwashers.

Discussion of Related Art

In general, the dishwasher is a machine for housing cleaning objects in a treatment space, and removing dirt from the cleaning objects by using cleaning water (in some cases, even drying of the treatment objects is possible).

Referring to FIG. 1, a transverse section of a related art dishwasher 1 is illustrated. The dishwasher 1 is provided with a cabinet 10, which forms an exterior appearance of the dishwasher 1. The cabinet 10 has a door 12 on a front thereof for introducing cleaning objects, such as tableware, into the cabinet 10, through the opened door 12.

Provided in the cabinet 10, there is a tub 20 for providing the housing space for housing the cleaning objects therein. Provided in the tub 20, there are racks 32 and 34 for receiving and securing the cleaning objects thereto, directly. There may be an upper rack 32 and a lower rack 34 as shown. In some implementations, the number of the racks 32 and 34 are not limited.

The dishwasher 1 may include a sump 60 for supplying the cleaning water to at least one of spray arms 42 and 44. The sump 60 may have cleaning water supplied to the sump through a water supply line 70, and may supply the cleaning water to the spray arms 42 and 44 by driving a water supply pump 72.

For this, the sump 60 has supply flow passages 62 and 64 connected to the spray arms 42 and 44, respectively. The supply flow passages 62 and 64 are provided corresponding to the spray arms 42 and 44. For an example, if the dishwasher 1 has an upper spray arm 42 and a lower spray arm 44, the supply flow passages 62 and 64 may be an upper supply flow passage 62 and a lower supply flow passage 64.

The sump 60 may be configured to drain the cleaning water to an outside of the dishwasher 1 after cleaning is finished. That is, after cleaning the cleaning objects, such as tableware, housed in the tub 20, the cleaning water is collected in the sump 60, and drained to an outside of the dishwasher 1 through a drain line 76 by driving a drain pump 74.

Since the tub 20 serves to fix a housing capacity of the cleaning objects, it is preferable that the tub 20 is provided to secure a capacity of the housing space in the cabinet 10 to a maximum.

However, because the spray arms 42 and 44 are provided separately under the racks 32 and 34 that receive and secure the cleaning objects for spraying the cleaning water, the dishwasher 1 fails to secure the capacity of the housing space 14 in the cabinet 10 to the maximum.

Moreover, the spray arms mounted under the racks spaced from each other in one to one fashion for each of the racks due to a structural nature require a comparatively long cleaning time period.

SUMMARY OF THE DISCLOSURE

An object of the present invention is to provide a dishwasher that can secure a capacity of a housing space in a cabinet to a maximum.

Another object of the present invention is to provide a dishwasher that can clean cleaning objects more quickly, with a better effect than a related art spray arm.

Additional advantages, objects, and features of the disclosure will be set forth in part in the description that follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these objects and other advantages and in accordance with the purpose of the invention, as embodied and broadly described herein, in one aspect, a spray module is provided that rotates within a fixed angle range for spraying cleaning water to cleaning objects.

The spray module includes a spray nozzle, and the spray nozzle includes two moment arms provided to opposite sides of the body for making the spray nozzle rotate within a fixed angle range with reference to an axis direction.

The spray module includes a second coupling portion and two stoppers projected toward the spray nozzle for limiting an angle of movement of the two moment arms.

Implementations may include one or more of the following features. At least two spray modules may be provided. The spray module may include the second coupling portion having at least two communication portions each for having the opened end of the spray nozzle rotatably fastened thereto.

In another aspect, a dishwasher includes a cabinet which forms an exterior appearance thereof, having a door on one side thereof, which can be opened and closed, a tub provided in the cabinet to form a cleaning object housing space, a rack provided in the tub for securing cleaning objects thereto, a spray module rotatable within a fixed angle range for spraying cleaning water toward the cleaning objects, a sump for supplying cleaning water to the spray module, and a supply flow passage having one end in communication with the spray module and the other end connected to the sump for providing a flow passage of the cleaning water being supplied from the sump.

Implementations may include one or more of the following features. The spray module may include a spray nozzle for spraying the cleaning water to the cleaning objects received at the rack within a fixed angle range, a first fastening unit fastened to one end of the spray nozzle and attachable/detachable to/from the rack, and a second fastening unit fastened to the other end of the spray nozzle and attachable/detachable to/from the rack.

The spray nozzle may include a cylindrical hollow body having a closed end and an opened end, a plurality of spray holes formed at fixed intervals in a length direction of the body for spraying the cleaning water, and two moment arms provided to opposite sides of the body for enabling the spray nozzle to rotate with reference to an axis direction within a fixed angle range.

Each of the two moment arms may have a hollow in communication with the body for introducing the cleaning water to the body, and a propulsion hole formed upward for providing a momentum to the moment arm by spraying the cleaning water thus introduced.

The second fastening unit may include a second fastening member for coupling to the rack detachably, and a second coupling portion having a communication portion extended from the second fastening member to be fastened to an inside circumference of the opened end of the body for having the cleaning water supplied thereto from the sump, while allowing the opened end of the spray nozzle to be rotatable.

The communication portion may have two spray holes formed in opposite sides for introducing the cleaning water to the two moment arms, respectively.

The two moment arms may be formed on opposite sides of an outside circumference of the body having the communication portion coupled thereto, respectively.

The second coupling portion may have two stoppers formed projected toward the spray nozzle for limiting angles of movement of the two moment arms, respectively.

The two moment arms have cylinder shapes formed on opposite sides of the body in a tangential direction of the body and in communication with the body respectively for spraying the cleaning water upward and enabling the spray nozzle to rotate within a fixed angle range with reference to an axis direction.

The first fastening unit may include a first fastening member for coupling to the rack detachably, and a first coupling portion formed extended from the first fastening unit to be fastened to an outside circumference of the closed end of the body for having the closed end of the body to be fastened thereto, rotatably.

The second fastening unit may include a second fastening member for coupling to the rack detachably, and a second coupling portion having a communication portion formed extended from the second fastening member to be fastened to an inside circumference of the opened end of the body for having the cleaning water supplied thereto from the sump while the opened end of the body is rotatable.

The communication portion may have two spray holes in opposite sides thereof for introducing the cleaning water to the two moment arms, respectively.

The two moment arms may be formed on opposite sides of an outside circumference of the body having the communication portion coupled thereto.

The second coupling portion may have two stoppers formed projected toward the spray nozzle for limiting angles of movement of the two moment arms, respectively.

The spray module may include a plurality of spray nozzles for spraying the cleaning water to the cleaning objects in the rack within a fixed angle range, a first fastening unit to be fastened to one end of the spray nozzle and attachable/detachable to/from the rack, and a second fastening unit to be fastened to the other end of the spray nozzle and attachable/detachable to/from the rack.

The second fastening unit may include a second fastening member for coupling to the rack detachably, and a second coupling portion having at least two communication portions formed extended from the second fastening member to be fastened to an inside circumference of the opened end of the body for having the cleaning water supplied thereto from the sump while the opened end of the body is rotatable.

In another aspect, a dishwasher includes a cabinet which forms an exterior appearance thereof, the cabinet having a door on one side thereof, which can be opened and closed, a tub provided in the cabinet to form a cleaning object housing space, a rack provided in the tub for securing cleaning objects thereto, a spray module rotatably provided for spraying cleaning water toward the cleaning objects, and a supply flow passage for supplying the cleaning water to the spray module, wherein the spray module is rotated by a reaction force to a spray force of the cleaning water.

Implementations may include one or more of the following features. The spray module may have a propulsion hole positioned a predetermined distance from a rotary axis of the spray module for spraying the cleaning water, wherein the propulsion hole sprays the cleaning water toward an outside of a plane formed by the propulsion hole and the rotary axis.

The spray module may include a rotatably provided body, a moment arm provided to a side of the body to have the propulsion hole for rotating with the body, and a fastening unit coupled to one end of the body for supporting the body and supplying the cleaning water to the moment arm.

The fastening unit may have a spray hole for supplying the cleaning water from the supply flow passage to the moment arm, wherein the moment arm and the spray hole may be in communication selectively as the moment arm rotates.

The fastening unit may include a fastening member for coupling to the rack detachably, and a communication portion formed extended from the fastening member for having one end of the body to be placed therein, wherein the communication portion may have a spray hole formed to be in communication with an inside of the moment arm selectively as the moment arm rotates.

The communication portion may be in communication with the inside of the body, and the cleaning water being supplied to the communication portion may be sprayed through the spray hole formed in the body.

The propulsion hole may include a first propulsion hole and a second propulsion hole, wherein the first propulsion hole and the second propulsion hole may spray the cleaning water to rotate the spray module in directions opposite to each other.

The spray module may include a first stopper for limiting rotation generated by the cleaning water spray of the first propulsion hole, and a second stopper for limiting rotation generated by the cleaning water spray of the second propulsion hole.

The spray module may make a pendulum motion between the first stopper and the second stopper.

The spray module may be detachably coupled under the rack.

In another aspect of the present invention, a spray module is included in a dishwasher for spraying cleaning water to tableware housed in a tub, the spray module provided to be rotatable centered on a rotary axis. The spray module comprises a propulsion hole positioned spaced a predetermined distance from the rotary axis for spraying cleaning water toward an outside of a plane formed by the propulsion hole and the rotary axis to rotate the spray module owing to a reaction force to a spray force of the cleaning water being sprayed from the propulsion hole.

Implementations may include one or more of the following features. The spray module may include a rotatably provided body, a first moment arm and a second moment arm provided to opposite sides of the body to have the first propulsion hole and the second propulsion hole formed therein respectively for rotating with the body; and a fastening unit coupled to one end of the body for supporting the body and supplying the cleaning water to the moment arms. The first propulsion hole and the second propulsion hole may spray the cleaning water to rotate the body in directions opposite to each other.

The fastening unit may have a first spray hole for supplying the cleaning water from a supply flow passage to the first moment arm, and a second spray hole for supplying the cleaning water from the supply flow passage to the second moment arm. The first spray hole may be brought into communication with the first moment arm and the second spray hole may be brought into communication with the second moment arm selectively as the body rotates.

The first moment arm and the second moment arm may be formed extended in side directions of the body, respectively.

The first moment arm and the second moment arm may be extended from the body to form an angle that is less than 180 degrees.

The body may have a cylindrical shape and the first moment arm and the second moment arm may be formed extended in a tangential direction to the body.

The spray module may include a first stopper for limiting rotation of the first moment arm and a second stopper for limiting rotation of the second moment arm.

It is to be understood that both the foregoing general description and the following detailed description of the present invention are exemplary and explanatory and are intended to provide further explanation of the invention as claimed.

DESCRIPTION OF THE DRAWINGS

The accompanying drawings, which are included to provide a further understanding of the invention, illustrate embodiments of the invention and together with the description serve to explain the principle of the invention.

DETAILED DESCRIPTION

Reference will now be made in detail to the specific embodiments of the present invention, examples of which are illustrated in the accompanying drawings.

As far as there is no specific definition, each of terms in the specification is the same with a general meaning of the term understood by persons skilled in this field of art, and, if the term used in the specification conflicts with the general meaning of the term, the meaning of the term used in the specification prevails.

However, a dishwasher to be described hereinafter is provided only for describing embodiments of the present invention, but not for limiting scope of patent rights of the present invention, and, wherever possible, the same reference numbers will be used throughout the drawings to refer to the same or like parts.

A dishwasher in accordance with a preferred embodiment of the present invention may include a cabinet that forms an exterior appearance thereof having a door on one side, which can be opened and closed. The dishwasher may include a tub provided in the cabinet to form a housing space for cleaning objects. The dishwasher may include a rack provided to the tub for securing the cleaning objects thereto. The dishwasher may include a spray module rotatably provided thereto for spraying cleaning water toward the cleaning objects. The dishwasher may include a supply flow passage for supplying the cleaning water to the spray module. The supply flow passage provides a flow passage for supplying the cleaning water from a sump in the tub to the spray module. Alternatively, the supply flow passage may be a flow passage for supplying the cleaning water from an external water supply source to the spray module.

The dishwasher of the present invention includes "a spray module" which can replace an existing spray arm for securing a housing space in the dishwasher larger than the related art dishwasher, and a cleaning performance better than the related art dishwasher.

Therefore, the dishwasher of the present invention will be described putting emphasis on a configuration of the dishwasher related to the spray module of the present invention.

A principle of operation of the spray module in accordance with a preferred embodiment of the present invention will be described with reference to FIG. 3.

Figure 3:
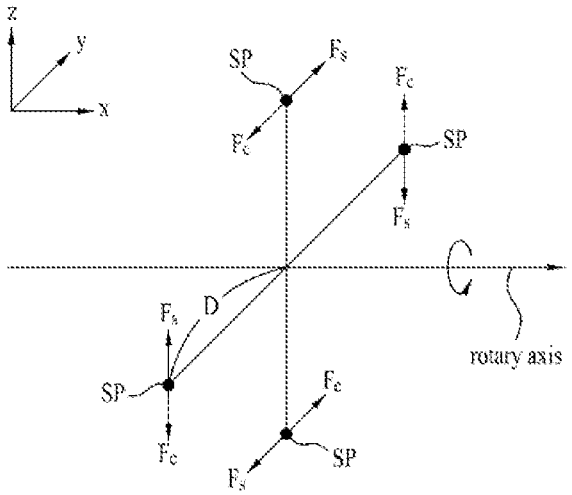
FIG. 3 illustrates a schematic view showing operation of a spray module in accordance with a preferred embodiment of the present invention.

Referring to FIG. 3, a schematic view showing operation of a spray module in accordance with a preferred embodiment of the present invention is illustrated. The spray module is rotatably provided for spraying cleaning water toward the cleaning objects. In this case, the spray module is rotated by a reaction force Fc to a spraying force Fs of the cleaning water. The spray module has a propulsion hole SP for spraying the cleaning water, and the cleaning water is sprayed through the propulsion hole SP.

Referring to FIG. 3, the spray module rotates round a rotary axis. In this case, a force that rotates the spray module is the reaction force Fc to the spray force Fs of the cleaning water. The propulsion hole SP is spaced a predetermined distance from the rotary axis of the spray module. If the cleaning water is sprayed from the propulsion hole SP, the reaction force Fc is generated in a direction opposite to a direction of spray of the cleaning water, to rotate the spray module. The spray module has both ends rotatably supported on an inside of the rack or the tub. As an example, if only one propulsion hole SP is provided, moment M that rotates the spray module can be calculated by cross product of a distance D vector between the rotary axis of the spray module and the propulsion hole SP and the reaction force Fc. The distance D between the rotary axis of the spray module and the propulsion hole SP acts as a moment arm. Therefore, the rotation moment M of the spray module is proportional to the distance between the propulsion hole SP and the rotary axis and the reaction force Fc generated at the propulsion hole SP. In order to generate the moment that rotates the spray module, it is preferable that the propulsion hole SP sprays the cleaning water in a direction that makes the cross product not to be zero. Therefore, if the spray module rotates centered on a z-axis, it is preferable that the propulsion hole SP sprays the cleaning water toward an outside of a xy-plane. That is, it is preferable that the propulsion hole SP sprays the cleaning water toward an outside of a plane xz the propulsion hole SP and the rotary axis of the spray module form. In this case, in order to make the cross product to be largest (i.e., in order to make the rotation moment to be largest), it is preferable that the propulsion hole SP sprays the cleaning water in a direction perpendicular to the xy-plane.

An implementation in which the spray module is rotated by the reaction force Fc to the spray force Fs of the cleaning water like the present invention may not require a separate member motor for rotating the spray module. A production process of the dishwasher becomes simple to enable a reduction in the production cost, and a maintenance cost required for repairing faults of electric machines, such as the motor for rotating the spray module, can be reduced.

There is at least one propulsion hole SP, and preferably two. In implementations with two propulsion holes SP, it is preferable that the propulsion holes SP are positioned on opposite sides of the rotary axis of the spray module. That is, the two propulsion holes SP may be provided to two spaces divided by the XZ plane (or the XY plane), respectively. In this case, while it is preferable that the two propulsion holes SP are positioned at opposite points, the positions are not limited to this.

In addition, if a plurality of propulsion holes SP are provided, the spray module may be designed to rotate in one direction (clockwise (CW) or counter-clockwise (CCW)), or in the CW and the CCW directions alternately by adjusting directions of the cleaning water being sprayed from the propulsion holes SP. If the plurality of the propulsion holes SP are positioned on opposite sides of the rotary axis, the directions of spray of the cleaning water from the plurality of the propulsion holes SP are designed to be opposite to each other for making the spray module rotate in one direction. For example, if one of the two propulsion holes SP on a y-axis on opposite sides of the rotary axis (z) sprays the cleaning water in a z-direction, and the other one of the two propulsion holes SP sprays the cleaning water in a -z direction, the spray module can rotate in one direction. If the plurality of the propulsion holes SP are positioned on opposite sides of the rotary axis, the spray directions of the cleaning water to be sprayed from the plurality of the propulsion holes SP are designed to be the same for making the rotation directions of the spray module alternate. For example, if both of the two propulsion holes SP provided on the y-axis on opposite sides of the rotary axis (z) spray the cleaning water in the z-direction (or, the -z direction), the spray module can rotate in directions opposite to each other, alternately. That is, if the propulsion hole includes a first propulsion hole and a second propulsion hole, the first propulsion hole and the second propulsion hole may spray the cleaning water to make the spray module rotate in directions opposite to each other, alternately.

In the foregoing example, although it is described that the direction of spray of the cleaning water from the propulsion hole SP is the z-direction perpendicular to the xz-plane as an example, it is apparent that the foregoing example includes a case in which the cleaning water is sprayed in a direction having a z-direction vector component for generating the rotation force, too.

Figure 2:
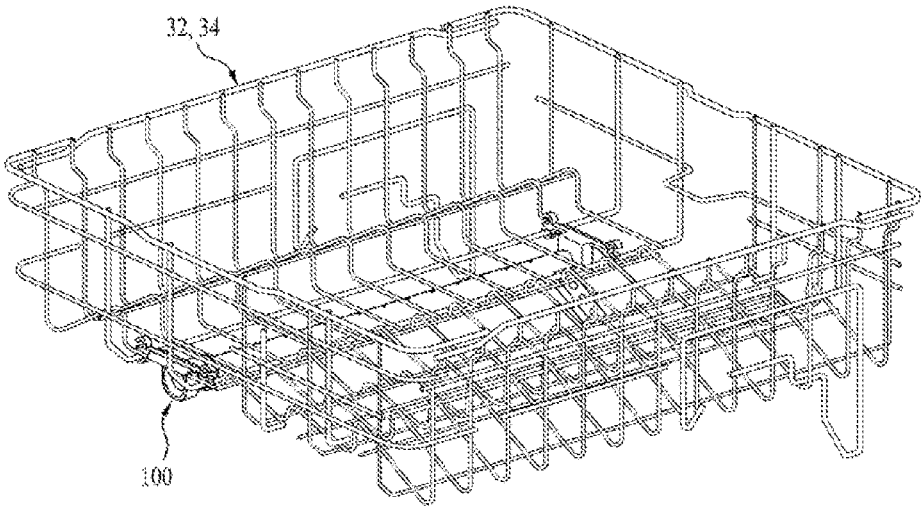
FIG. 2 illustrates a perspective view of a rack having a spray module mounted in accordance with a preferred embodiment of the present invention.

FIG. 2 illustrates a perspective view of a rack 32 having a spray module 100 mounted in accordance with a preferred embodiment of the present invention.

Figure 1:
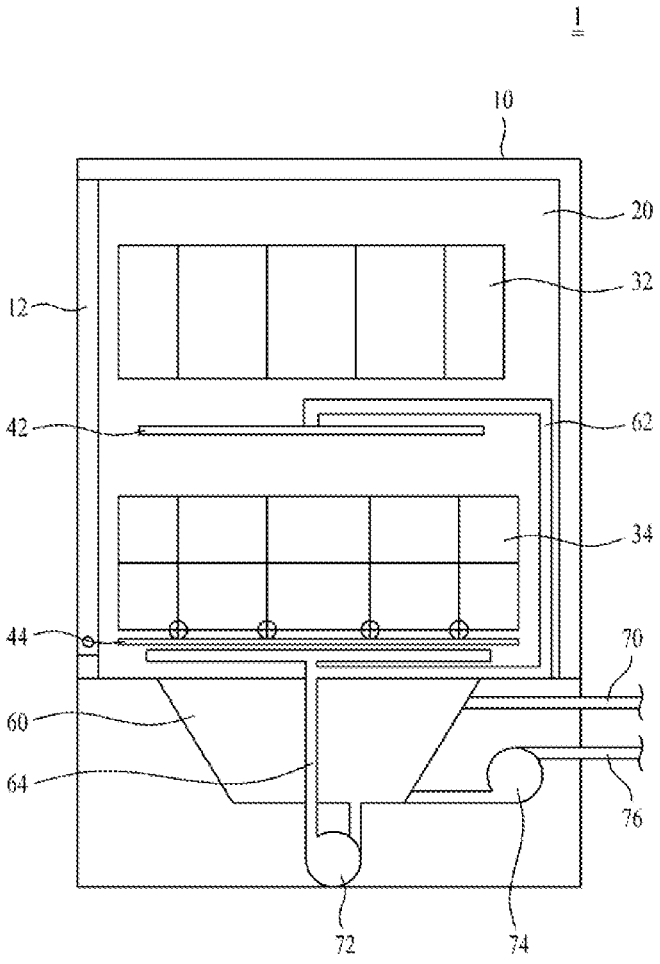
FIG. 1 illustrates a transverse section of a related art dishwasher.

Different from the related art dishwasher in FIG. 1, the dishwasher of the present invention may have both of the spray arms 42 and 44 removed therefrom. Alternatively, the dishwasher of the present invention may have only the upper spray arm 42, which affects the housing space in the tub 20 comparatively largely compared to the lower spray arm 44, removed therefrom, while having a spray module 100 mounted under the rack 32 or 34. That is, the spray module 100 may be supported by the rack 32 or 34. In some implementations, the spray module 100 may be rotatably supported by the rack 32 or 34. As described previously, the spray module 100 is rotated by the reaction force Fc to the spray force Fs of the cleaning water being sprayed.

In some implementations, the dishwasher of the present invention removes the spray arms 42 and 44, and mounts the spray module 100 under the rack 32 or 34 for securing a housing space in the dishwasher that is larger than the related art.

In the meantime, the cleaning water may be supplied to the spray module 100 through a second fastening unit 130 (see FIG. 4) of the spray module 100, which is described in a following section, via the supply flow passage 62 and 64 existing already fastened thereto.

Although FIG. 2 illustrates only one spray module 100 mounted to the rack 32, in some implementations, more than one spray module 100 are provided for securing adequate cleaning water spray coverage and improving a cleaning capability. The spray module 100 of the present invention may be mounted on the rack 32 or 34 to be rotatable at a fixed angle range, and preferably, detachable from the rack 32 or 34.

The spray module 100 may have a rotation direction changing periodically (where the period may be short) with reference to a direction of the rotation axis, to rotate as if the spray module 100 makes a pendulum motion within a fixed angle range (hereafter, such a motion is described as a "fixed angle range rotation motion"). Since the motion makes spray coverage large, and provides a hitting effect to the cleaning objects, the motion can provide a fast and excellent cleaning effect compared to the spray arm described in the related art. A configuration of the spray module 100 will be described in detail in the following sections.

Figure 4:
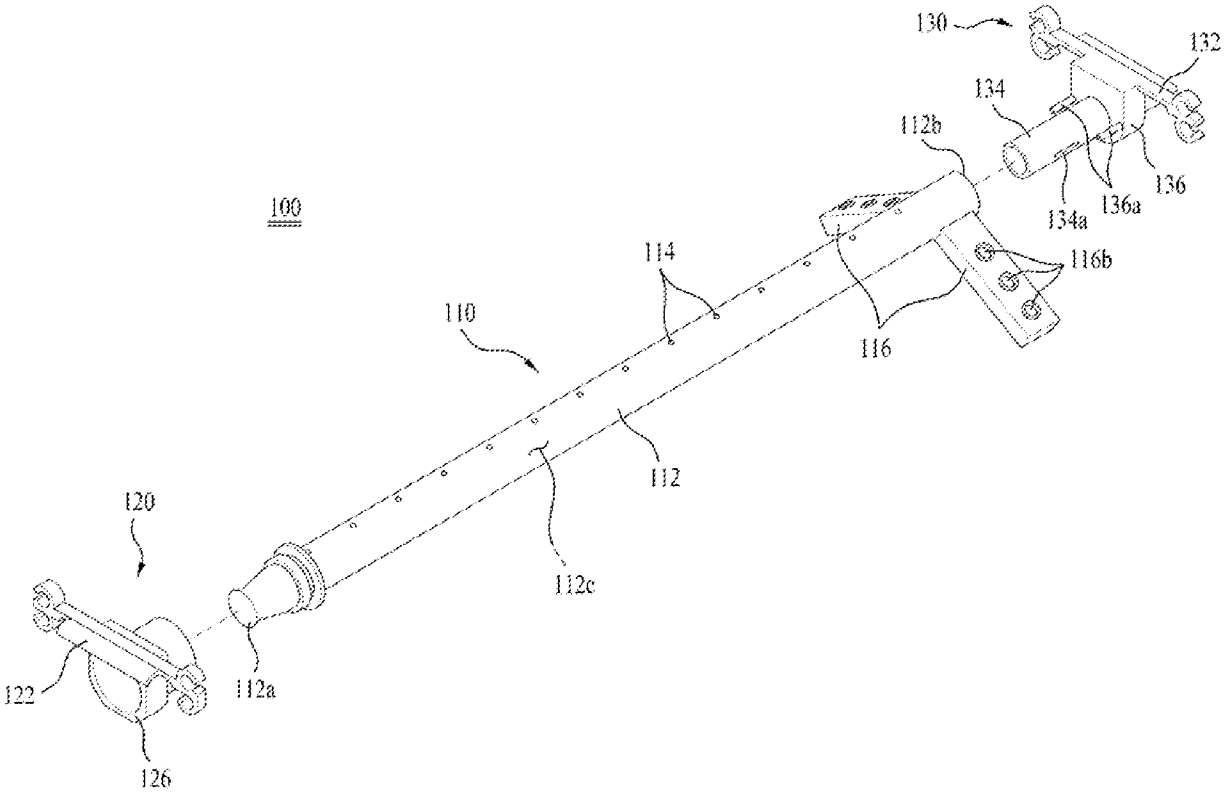
FIG. 4 illustrates an exploded perspective view of a spray module in accordance with a preferred embodiment of the present invention.
Figure 5:
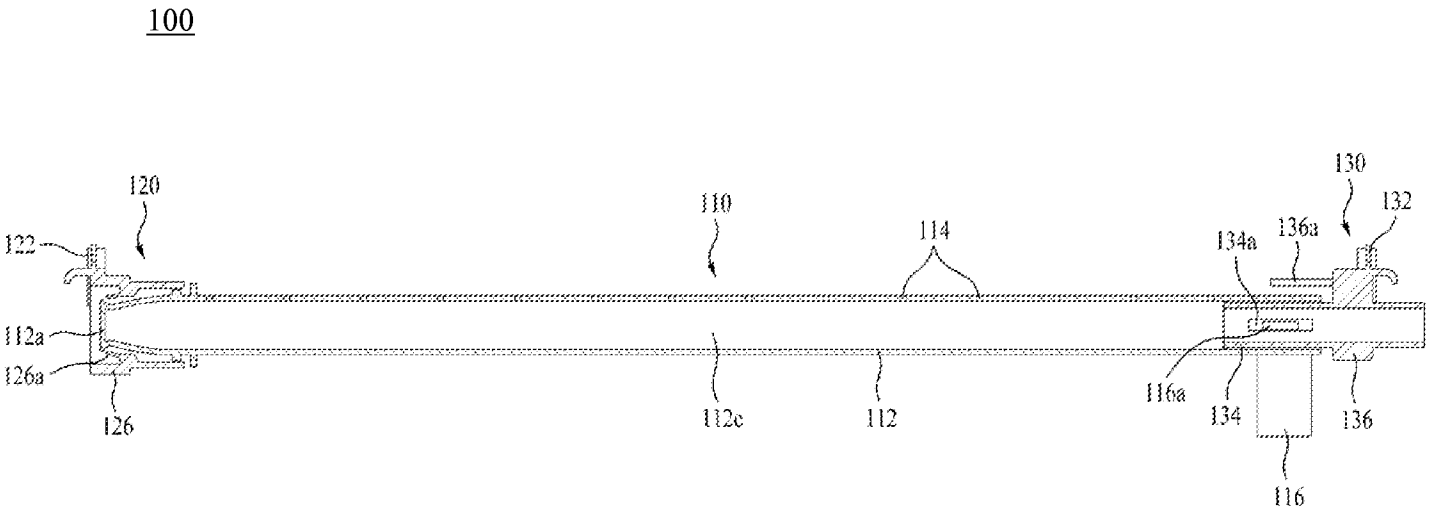
FIG. 5 illustrates a transverse section of a spray module in accordance with a preferred embodiment of the present invention.

FIG. 4 illustrates an exploded perspective view of a spray module 100 in accordance with a preferred embodiment of the present invention, and FIG. 5 illustrates a transverse section of a spray module 100 in accordance with a preferred embodiment of the present invention.

The spray module 100 may include a spray nozzle 110 for spraying the cleaning water to the cleaning objects in the rack 32 or 34 within a fixed spray angle. The spray module 100 may include a first fastening unit 120 fastened to one end of the spray nozzle 110 and detachably mounted to the rack 32 or 34. The spray module 100 may include a second fastening unit 130 fastened to the other end of the spray nozzle 110 and detachably mounted to the rack 32 or 34. The first fastening unit 120 serves to support the spray module 100 rotatably, and the second fastening unit 130 serves to support the spray module 100 rotatably and serves to supply the cleaning water to the spray module 100. Therefore, even though the spray module 100 may be supported only by the second fastening unit 130 without the first fastening unit 120, it is preferable to provide both of the first fastening unit 120 and the second fastening unit 130 for stable support of the spray module 100. The first fastening unit 120 and the second fastening unit 130 support both ends of the spray module 100, rotatably.

The spray module 100, more specifically the spray nozzle 110, may include a rotatably provided body 112. The body 112 has both ends rotatably supported by the first fastening unit 120 and the second fastening unit 130. Along with this, the body 112 may have a hollow 112*c* provided in a length direction thereof for introduction of the cleaning water thereto. The body 112 may have a closed end 112*a* formed at one side, and an opened end 112*b* formed at the other side. The closed end 112*a* is coupled to the first fastening unit 120, and the opened end 112*b* is coupled to the second fastening unit 130. In addition, the body 112 may have a plurality of spray holes 114 formed in a length direction thereof for spraying the cleaning water. The plurality of spray holes 114 are arranged at fixed intervals. The body 112 may include a moment arm 116 provided to a side of the body 112 to be rotatable together with the body 112. Two moment arms 116 may be provided to opposite sides of the body 112 so that the spray nozzle 100 can rotate within the fixed angle range with reference to the axis direction. The moment arm 116 has the propulsion holes 116*b* formed therein for spraying the cleaning water. As described previously, the body 112 can be rotated by the reaction force Fc to the spray force Fs of the cleaning water sprayed through the propulsion holes 116*b*. In order to generate the moment for rotating the body 112, the propulsion holes 116*b* are provided at positions spaced predetermined distances from the rotary axis of the body 112, respectively.

In some implementations, the body 112 may be formed to have a cylindrical shape, for the fixed angle range rotation motion of the spray module 100. However, in other implementations, the body 112 may have some other shape.

To form a rotatable fastening structure to the first coupling portion 126, which is described later, the closed end 112*a* of the body 112 has a stepped end such that the stepped end is fastened to the first coupling portion 126 passed through a detachment/attachment preventive rib 126*a* (as shown in FIG. 5) formed in the first coupling portion 126. Such a structure functions as a bearing.

The opened end 112*b* of the body 112 has the cleaning water introduced thereto through the supply flow passage 62 and 64. The cleaning water is thus introduced to the hollow 112*c* of the body 112, and sprayed to the cleaning objects secured in the racks 32 or 34 positioned on an upper side of the body 112 through the plurality of spray holes 114.

To make the spray nozzle 100 rotate within the fixed angle range with reference to the axis direction, one moment arm 116 is provided on each of the opposite sides of the body 112. The moment arm 116 may be formed extended in a side direction of the body 112. Preferably, the moment arm 116 may be formed on a side of the opened end 112*b* of the body 112 which is a portion with a highest pressure of the cleaning water being introduced to the body 112, for applying the high water pressure to the moment arm 116 enabling the quick fixed angle range rotation motion as the high pressure water is sprayed from the moment arm. The quick fixed angle range rotation motion, rather than a slow fixed angle range rotation motion, will enhance a frequency and a hitting effect of the spray of the cleaning water on to the cleaning objects, thereby increasing a cleaning effect.

Figure 7:
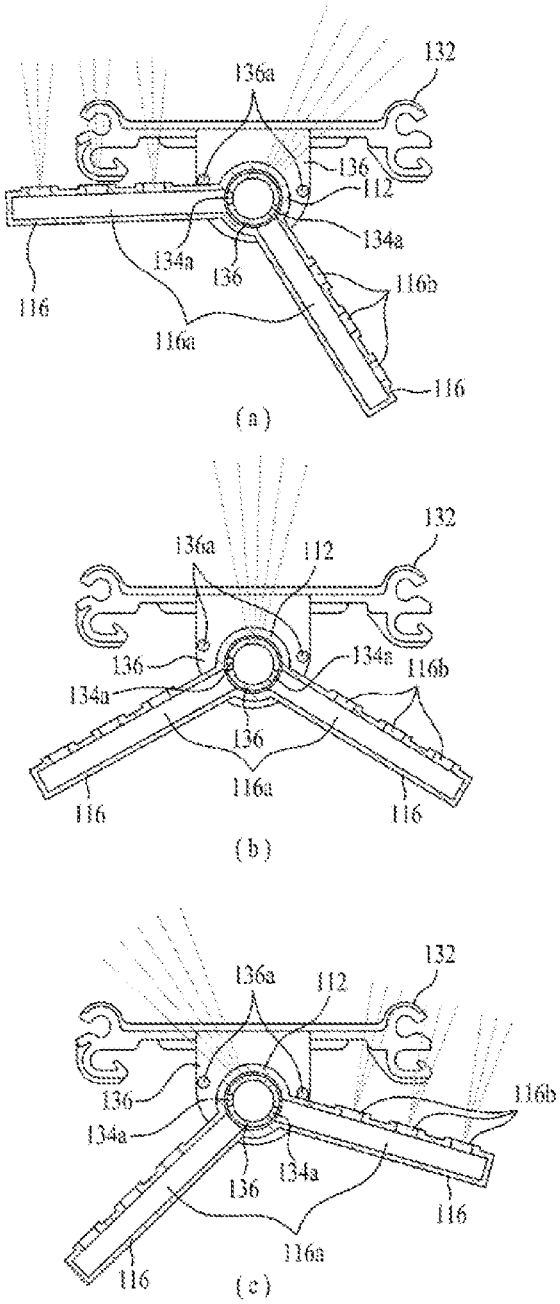
FIGS. 7A-7C illustrate schematic views for describing an operation mechanism of a spray module in accordance with a preferred embodiment of the present invention.

For this, it is preferable that each of the moment arms 116 has a hollow portion 116*a* formed to be in communication with the body 112 to introduce the cleaning water thereto (as shown in FIG. 7), and a propulsion hole 116*b* formed to spray the cleaning water upward for providing a momentum to the moment arm by spraying the cleaning water thus introduced. The two moment arms 116 may be provided extended in opposite directions from the axis of rotation of the body. The two moment arms 116 may be arranged to form 180 degrees from each other. However, in some implementations, the two moment arms 116 are arranged to form an angle smaller than 180 degrees for the pendulum motion, which is described later. The angle formed by the two moment arms 116 may be adjusted appropriately according to the spray coverage of the cleaning water provided by the pendulum motion of the moment arms 116 that is described later. The moment arms 116 may have the cleaning water supplied thereto through the second fastening unit 130.

If the cleaning water is sprayed at the high pressure through the propulsion hole 116*b*, the moment arm 116 obtains a propulsion force (that is, the reaction force Fc) that tends to move in a direction opposite to the direction of spray of the cleaning water. Such an operation mechanism is described later with reference to FIGS. 6 and 8.

The first fastening unit 120 may include a first fastening member 122 for coupling to the rack 32 or 34 detachably, and a first coupling portion 126 fastened to an outside circumference of the closed end 112*a* of the body 112 extended from the first fastening member 122 while allowing the closed end 112*a* of the body 112 to be rotatable.

To make the first fastening member 122 detachable from the rack 32 or 34, the first fastening member 122 may have a hook shape. However, the shape that makes the first fastening member 122 detachable from the rack 32 or 34 is not limited to the hook shape.

As described previously, the first coupling portion 126 may include the detachment/attachment preventive rib 126*a* therein for preventing the stepped end of the closed end 112*a* from detaching/attaching from/to the first fastening unit 120.

That is, referring to FIG. 5, the closed end 112*a* of the body 112 of the spray nozzle 110 has the stepped end held at the detachment/attachment preventive rib 126*a* of the first coupling portion 126. To fasten the spray nozzle 110 rotatably, it is preferable that the first coupling portion 126 and the body 112 are not fastened closely.

The second fastening unit 130 may include a second fastening member 132 for coupling to the rack 32 or 34 detachably. The second fastening unit 130 may also include a second coupling portion 136 having a communication portion 134 formed extended from the second fastening member 132 to be fastened to an inside circumference of the opened end 112*b* of the body 112 for having the cleaning water supplied thereto from sump 60, while allowing the opened end 112*b* of the spray nozzle to be rotatable. The second fastening unit 130 has a spray hole 134*a* for supplying the cleaning water from the supply flow passage to the moment arm 116. In this case, the spray hole 134*a* may be in communication with the moment arm 116 selectively according to rotation of the moment arm 116. The spray hole 134*a* may be formed in the communication portion 134.

To fasten to the rack 32 or 34 detachably, the second fastening member 132 may have a hook shape. However, the shape for fastening the second fastening member 132 to the rack 32 or 34 detachably is not limited to the hook shape.

The second coupling portion 136 has the communication portion 134 extended therefrom for introducing the cleaning water from the sump 60 to the spray nozzle 110 through the communication portion 134. Since the spray nozzle 110 includes the body 112 and the moment arm 116, the cleaning water introduced thus may be introduced to at least one of the body 112, and the moment arm 116, and, preferably, both to the body 112 and the moment arm 116.

The communication portion 134 has the spray holes 134*a* matched to a number of the moment arms 116. As shown in FIG. 7, the communication portion 134 has two spray holes 134*a* in opposite sides for introducing the cleaning water to the two moment arms 116, respectively. To generate the pendulum motion of the moment arms 116, the moment arms 116 are in communication selectively with the spray holes 134*a*. If N moment arms 116 are provided, a designated number of the moment arms 116 in communication with the spray holes 134*a* at a given time are less than N. As shown in FIG. 7, if two moment arms 116 and two spray holes 134*a* are formed, it is designed to make only one of the spray holes 134*a* is in communication with the moment arm 116 at a given time. As the moment arms 116 rotate, one of the moment arms 116 is configured to be communication selectively with one of the two spray holes 134*a*. The communication portion 134 is in communication with an inside of the body 112, and the cleaning water introduced to the communication portion 134 may be sprayed through the spray hole 114.

In detail, in order to supply the cleaning water for providing a momentum to the moment arm 116, the two spray holes 134*a* are formed at positions matched to positions that the two moment arms 116 are formed thereon, respectively.

Moreover, in order to limit an angle of movement of the two moment arms 116, the second coupling portion 136 may have two stoppers 136 projected toward the spray nozzle 110. Since the stoppers 136 are brought into contact with the two moment arms 116 frequently, in some implementations the stoppers 136 are formed as one unit with the second coupling portion 136 for endurance reasons.

Another embodiment of the second fastening unit embodied for a case in which a plurality of spray modules 100 are mounted under the rack 32 or 34 is described with reference to FIG. 6.

Figure 6:
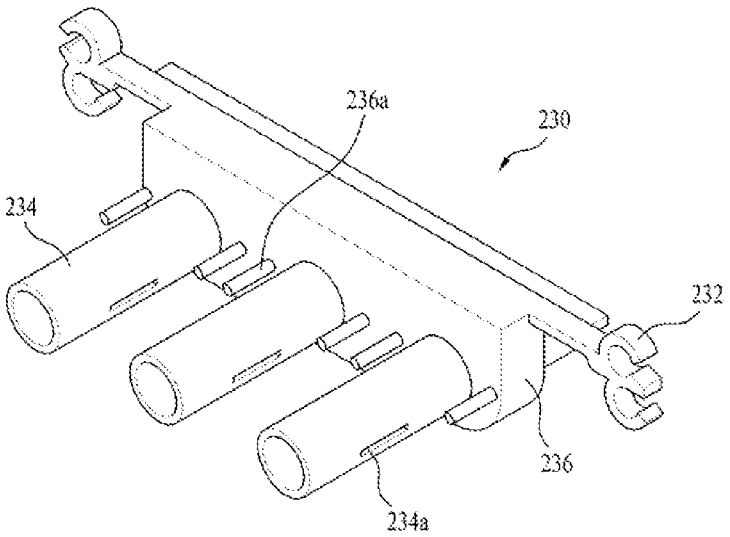
FIG. 6 illustrates a perspective view of a second fastening unit of a spray module in accordance with a preferred embodiment of the present invention.

FIG. 6 illustrates a perspective view of a second fastening unit 230 of a spray module in accordance with a preferred embodiment of the present invention. In some implementations, the second fastening unit 230 may be embodied when three spray nozzles 110 are provided. However, in some other implementations, the second fastening unit 230 may be embodied with a number of the spray nozzles 100 that is not within a predetermined range.

The second fastening unit 230 may include a second fastening member 232 for coupling to the rack 32 or 34 detachably, and a second coupling portion 236 having at least two communication portions 234 each formed extended from the second fastening member 232 to be fastened to an inside circumference of the opened end 112*b* of the body 112 for having the cleaning water supplied thereto from the sump while allowing the opened end 112*b* of the body 112 to be rotatable.

Since the second fastening unit 230 can be fastened to the supply flow passage in one-to-one fashion for having the cleaning water supplied thereto, additional branch pipes are not used for connection to single supply flow passage like a case in which individual second fastening portions 130 are provided.

Moreover, for example, if the second coupling portion 236 having three communication portions 234 is used, and if it is indented to fasten only two spray nozzles 110 thereto, the remaining communication portion 234 may be closed with a blanking member to prevent the cleaning water from leaking.

The operation mechanism of the spray module 100 in accordance with a preferred embodiment of the present invention is described in the following section.

FIGS. 7A-7C illustrate schematic views for describing an operation mechanism of a spray module in accordance with a preferred embodiment of the present invention.

In order to make smooth fixed angle range rotation of the spray nozzle 110, the spray holes 134*a* in the second coupling portion 136 and the opened end 112*b* of the body 112 having the two moment arms 116 formed extended therefrom are fastened at fixed intervals. The cleaning water being sprayed from the propulsion holes 116*b* in the two moment arms 116 rotate the spray module in directions opposite to each other. That is, the cleaning water being sprayed from the propulsion holes 116*b* in a left side moment arm 116 rotates the spray module 100 in a counted clockwise direction, and the cleaning water being sprayed from the propulsion holes 116*b* in a right side moment arm 116 rotates the spray module 100 in a clockwise direction.

Referring to a state of the spray module shown in FIG. 7A, the left side moment arm 116 is moved up until the left side moment arm 116 touches the left side stopper 136*a*. In this case, the left side spray hole 134*a* and the left side moment arm 116 are in communication to introduce the cleaning water to the left side moment arm 116, while the right side spray hole 134*a* and the right side moment arm 116 are not in communication. The left side stopper 136*a* limits rotation generated by the cleaning water spray of the propulsion hole 116*b* in the right side moment arm 116.

Since the cleaning water is supplied from the sump 60 at a high pressure, the cleaning water introduced to the hollow 116*a* in the left side moment arm 116 is sprayed through the propulsion holes 116*b* formed upward. It is to be noted that the cleaning water introduced to the body 112 is sprayed from the spray holes 114 in a one~two o'clock direction as shown in FIG. 7A. In this case, the left side moment arm 116 obtains a momentum (a propulsion force) intending to rotate in the counter clockwise direction, to rotate the spray module 100 in the counter clockwise direction, owing to the propulsion force (which is a reaction force). Once the rotation in the counter clockwise direction is made, the spray module 100 rotates to a state shown in FIG. 7C after passing through a state shown in FIG. 7B owing to inertia of the rotation in the counter clockwise direction, such that the right side moment arm 116 moves upward until the right side moment arm 116 touches the right side stopper 136*a*. In this case, the right side spray hole 134*a* and the right side moment arm 116 are in communication to introduce the cleaning water thereto, while the left side spray hole 134*a* and the left side moment arm 116 are not in communication. The right side stopper 136*a* limits rotation generated by the cleaning water spray from the propulsion holes 116*b* in the left side moment arm 116.

Accordingly, the cleaning water introduced to the hollow 116*a* in the right side moment arm 116 is sprayed through the propulsion holes 116*b* formed upward. It is to be noted that the cleaning water introduced to the body 112 is sprayed from the spray holes 114 in a ten~eleven o'clock direction as shown in FIG. 7C. In this case, the right side moment arm 116 obtains a momentum (a propulsion force) tending to rotate in the clockwise direction.

However, the propulsion holes 116*b* may be formed to face down, and a mechanism of such a case can be inferred analogically from above description. Due to the principle of motion described above, the spray module 100 can make a pendulum motion between the left side stopper 136*a* and the right side stopper 136*a*.

Since the water pressure of the cleaning water being supplied from the sump 60 is comparatively high, the fixed angle range rotation motion (that is, the pendulum motion) is repeated for a few to a few tens of times per a second, to spray the cleaning water to the cleaning objects secured to the rack 32 or 34 with a large spray angle. The fixed angle range rotation motion can improve the cleaning performance, and reduce the cleaning time period.

Figure 8:
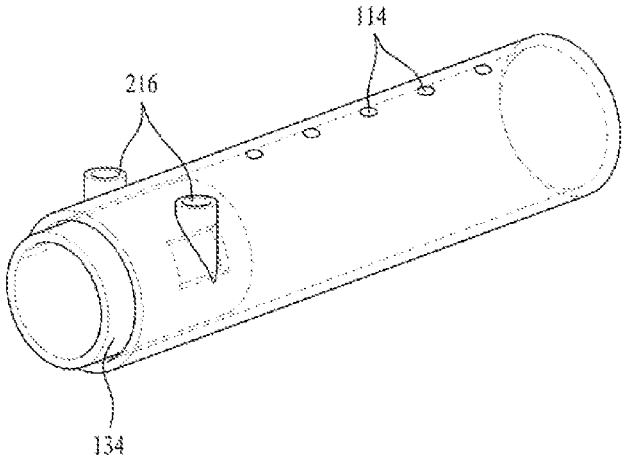
FIG. 8 illustrates a conceptual drawing of a spray module in accordance with another preferred embodiment of the present invention.

In the meantime, the spray module 100 may be embodied with another embodiment. FIG. 8 illustrates a conceptual drawing of a spray module 100 in accordance with another preferred embodiment of the present invention. Referring to FIG. 8, the spray module 100 has a structural difference in the two moment arms 216, compared to the spray module 100 described previously with respect to FIG. 4 or FIGS. 7A-7C.

The two moment arms 216 have cylindrical shapes formed on opposite sides of the body 112 in a tangential direction to the body 112 and in communication with the body 112 for spraying the cleaning water upward and enabling the spray nozzle 110 to rotate within a fixed angle range with reference to an axis direction. That is, a structurally simplified two moment arms 216 are formed on the body 112.

The cleaning water sprayed from the propulsion holes 216*b* in the two moment arms 216 rotates the spray module in directions opposite to each other. That is, the cleaning water sprayed from the propulsion holes 216*b* in the left side moment arm 216 rotates the spray module in 100 in the counter clockwise direction, and the cleaning water sprayed from the propulsion holes 216*b* in the right side moment arms 216 rotates the spray module 100 in the clockwise direction.

The operation of the spray module 100 shown in FIG. 8 is described in the following section.

Figure 9:
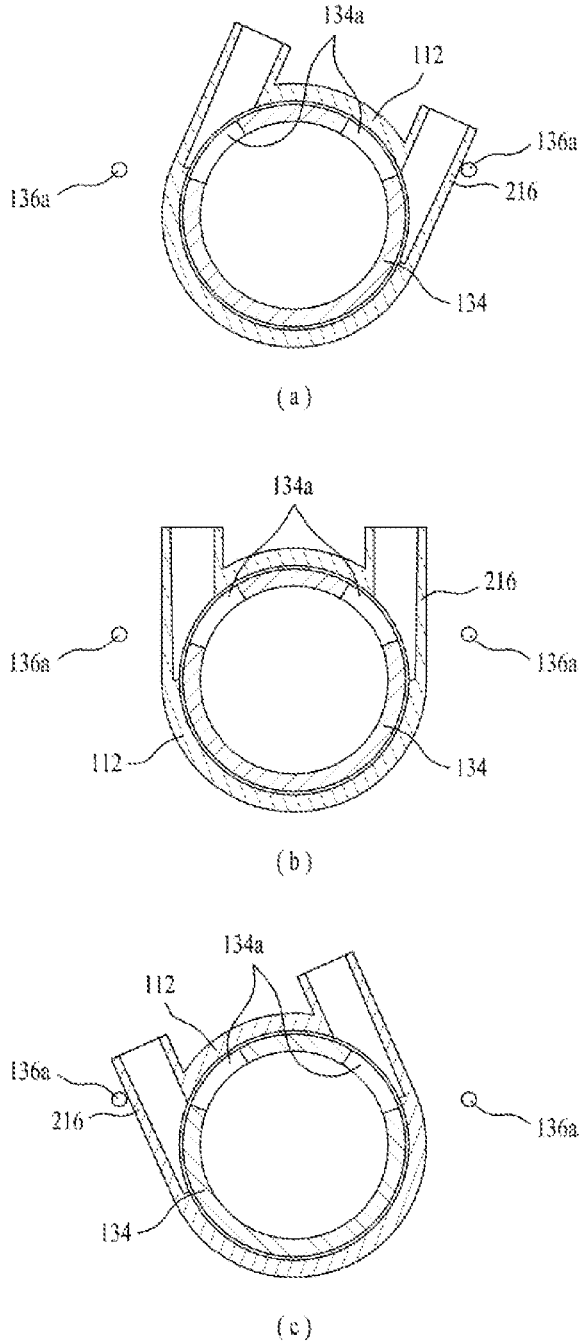
FIGS. 9A-9C illustrate schematic views for describing an operation mechanism of a spray module in accordance with another preferred embodiment of the present invention.

FIGS. 9A-9C illustrate schematic views for describing an operation mechanism of a spray module 100 in accordance with another preferred embodiment of the present invention.

Referring to a state of the spray module 100 shown in FIG. 9A, the left side moment arm 216 is moved up until the right side moment arm 216 touches the right side stopper 136*a*. In this case, the left side spray hole 134*a* and the left side moment arm 216 are in communication to introduce the cleaning water to the left side moment arm 216, while the right side spray hole 134*a* and the right side moment arm 216 are not in communication. The right side stopper 136*a* limits rotation generated by the cleaning water spray of the propulsion hole 216*b* in the right side moment arm 216.

Since the cleaning water is supplied from the sump 60 at a high pressure, the cleaning water introduced to the left side moment arm 216 hits an outer side wall of the left side moment arm 216 and is sprayed in a one~two o'clock direction (the cleaning water introduced to the body 112 is also sprayed from the spray holes 114 in the figure in the one~two o'clock direction). In this case, the left side moment arm 216 obtains a momentum (a propulsion force) tending to rotate in the counter-clockwise direction, to rotate the spray module 100 in the counter-clockwise direction, owing to the propulsion force (which is a reaction force). Once the rotation in the counter-clockwise direction is made, the spray module 100 rotates to a state shown in FIG. 9C after passing through a state shown in FIG. 9B owing to inertia of the rotation in the counter-clockwise direction, such that the right side moment arm 216 moves upward until the left side moment arm 216 touches the left side stopper 136*a*. In this case, the right side spray hole 134*a* and the right side moment arm 216 are in communication to introduce the cleaning water thereto, while the left side spray hole 134*a* and the left side moment arm 216 are not in communication.

Accordingly, the cleaning water introduced to the right side moment arm 216 hits an outer side wall of the right side moment arm 216 and is sprayed in a ten~eleven o'clock direction (the cleaning water introduced to the body 112 is also sprayed from the spray holes 114 on the drawing in the ten~eleven o'clock direction). In this case, the right side moment arm 116 obtains a momentum (a propulsion force) tending to rotate in the clockwise direction.

In some implementations, the moment arms 216 may be formed to face downwards, and the operation of such an implementation can be inferred analogically from the above description.

Since the water pressure of the cleaning water being supplied from the sump 60 is comparatively high, the fixed angle range rotation motion (that is, the pendulum motion) is repeated for a few to a few tens of times per a second, to spray the cleaning water to the cleaning objects secured to the rack 32 or 34 with a large spray angle. The fixed angle range rotation motion can improve the cleaning performance, and reduce the cleaning time period.

As has been described in the previous sections, the dishwasher of the present invention includes a spray module detachably provided under the rack enabling the realization of a cleaning object housing space that is larger than in the related art.

In addition, the dishwasher of the present invention includes a spray module that is able to rotate within a fixed angle range permitting to clean the cleaning objects with an excellent cleaning effect.

It will be apparent to those skilled in the art that various modifications and variations can be made in the present invention without departing from the spirit or scope of the invention. Thus, it is intended that the present invention cover the modifications and variations of this invention provided they come within the scope of the appended claims and their equivalents.

What is claimed is:

1. A dishwasher comprising:

a cabinet that forms an exterior appearance thereof, the cabinet having a door on one side thereof, which can be opened and closed;

a tub provided in the cabinet to form a cleaning object housing space;

a rack provided in the tub for securing cleaning objects thereto;

a spray module rotatably provided for spraying cleaning water toward the cleaning objects; and a supply flow passage for supplying the cleaning water to the spray module, wherein the spray module is rotated by a reaction force to a spray force of the cleaning water, and wherein the spray module is rotatable on an axis horizontal to a bottom surface of the cabinet, wherein the spray module comprises:

a body provided rotatably, the body comprising:

a cylindrical cavity provided within the body along a longitudinal axis of the body and configured to receive the cleaning water; and spray jets formed along the longitudinal axis of the body and in fluid communication with the cylindrical cavity, the spray jets configured to spray the cleaning water toward the cleaning objects;

a first fastening unit coupled to one end of the body and configured to rotatably support the body, the first fastening unit comprising a first fastening member having a hook shape for coupling to the rack;

a second fastening unit coupled to the other end of the body and configured to rotatably support the body, the second fastening unit comprising:

a communication portion configured to extend into the cylindrical cavity to supply the cleaning water to the body; and a second fastening member having a hook shape for coupling to the rack;

a first moment arm extending from a first side of the body, the first moment arm comprising:

a first hollow portion configured to receive the cleaning water; and a first propulsion hole in fluid communication with the first hollow portion and configured to rotate the body in one direction about the longitudinal axis of the body by spraying the cleaning water; and a second moment arm extending from a second side of the body opposite to the first side, the second moment arm comprising:

a second hollow portion configured to receive the cleaning water; and a second propulsion hole in fluid communication with the second hollow portion and configured to rotate the body in the other direction about the longitudinal axis of the body by spraying the cleaning water, wherein the communication portion comprises:

a first spray hole formed in a first portion of a circumferential surface thereof and configured to spray the cleaning water to the first hollow portion; and a second spray hole formed in a second portion of the circumferential surface opposite to the first portion and configured to spray the cleaning water to the second hollow portion, and wherein an angle formed by the first spray hole and the second spray hole with respect to the longitudinal axis of the body is different from an angle formed by the first moment arm and the second moment arm with respect to the longitudinal axis of the body.

2. The dishwasher as claimed in claim 1, wherein the spray module includes:

a first stopper for limiting rotation generated by the cleaning water spray of the first propulsion hole; and a second stopper for limiting rotation generated by the cleaning water spray of the second propulsion hole.

3. The dishwasher as claimed in claim 2, wherein the spray module makes a pendulum motion between the first stopper and the second stopper.

4. The dishwasher as claimed in claim 2, wherein the spray module is detachably coupled under the rack.

* * * * *